United States Patent [19]

Smith

[11] Patent Number: 4,717,157

[45] Date of Patent: Jan. 5, 1988

[54] SELF-TENSIONING GAME NET

[75] Inventor: Max D. Smith, Evansville, Ind.

[73] Assignee: Indian Industries, Inc., Evansville, Ind.

[21] Appl. No.: 793,200

[22] Filed: Oct. 31, 1985

[51] Int. Cl.[4] ..... A63B 67/00; A63B 61/00

[52] U.S. Cl. ..... 273/411; 273/29 BC

[58] Field of Search ..... 273/411, 29 B, 29 BC, 273/395

[56] References Cited

U.S. PATENT DOCUMENTS

| | | | |
|---|---|---|---|
| 2,052,637 | 9/1936 | Lichtenstein | 273/29 B |
| 3,435,487 | 4/1969 | Mazzei et al. | 273/29 B |
| 3,649,011 | 3/1972 | Barnes | 273/29 B |
| 4,239,235 | 12/1980 | Torres | 273/395 |
| 4,478,420 | 10/1984 | Sowards | 273/411 |

FOREIGN PATENT DOCUMENTS

| | | | |
|---|---|---|---|
| 3339376 | 5/1985 | Fed. Rep. of Germany | 273/411 |
| 1015722 | 10/1952 | France | 273/411 |

*Primary Examiner*—Richard C. Pinkham
*Assistant Examiner*—Gary Jackson
*Attorney, Agent, or Firm*—Woodard, Emhardt, Naughton, Moriarty & McNett

[57] ABSTRACT

A self-tensioning volleyball net comprises an elongated net which has elastic stretch cord, with a first effective end and a second effective end attached by the first effective end to the net. The second effective end of the elastic stretch cord receives a hook which is adapted to be secured to an external net support. One embodiment has an elastic stretch cord with a first end and a second end fixedly attached to each other, so that a loop with a first effective end and a second effective end, as previously described, is formed. A second embodiment has an elastic stretch cord with a first end and a second end, wherein the first end of the elastic stretch cord is attached to the elastic stretch cord at a point distant from the second end of the elastic stretch cord to form a first effective end, and the second end of the elastic stretch cord is attached to the elastic stretch cord at a point distant from the first end to form a third effective end, and the second effective end is defined by the point where a hook is attached to the elastic stretch cord. The second embodiment further has a drawstring extending along an elongated edge of the net, with the drawstring fixedly attached to a pair of elastic stretch cords at the third effective end.

7 Claims, 4 Drawing Figures

SELF-TENSIONING GAME NET

BACKGROUND OF THE INVENTION

1. Field of the Invention

This invention relates to the field of amusement devices and more particularly to game nets suspended between external net supports with tension adjusting means.

2. Description of Related Art

Volleyball is a recreational activity that can be played either indoors or out of doors. Volleyball is very popular because it requires a very small playing area (regulation court is 60 feet by 30 feet) and because it requires very little playing apparatus. The only playing apparatus are a volleyball and a net to be extended between two teams and hung from some external support on its ends. Thus, because apparatus required to play the game is so minimal, many portable volleyball sets are available. One problem that arises with volleyball sets is that the net needs to be hung with very little sagging therein. Typical volleyball sets include standards or poles to which the net is secured by means of a kind of cord or a string. Tensioning the net is problematic because the net must be tied off at one end and then, while pulling against the weight of the net, it must be tied off at the other end. It is difficult to make a secure knot which will not slip or release tension in the net while pulling against the weight of the net. Also the method of securing the net must prevent the net from sliding down the supports to which it is attached. The present invention discloses a volleyball net including a self tension adjusting means designed to eliminate the problems of tying a net and to prevent sagging of the net. Thus, the invention disclosed in this application is an improvement over previous volleyball nets.

In addition to the typical type of volleyball net mentioned above, many variations have appeared and these are disclosed by the following group of patent references. Also disclosed by some of the following patents are various net securing devices. Each reference pertains in one way or another to volleyball nets or nets suspended between supports in general, though certain references are believed to be more relevant to the present invention than others.

| Patent No. | Patentee |
|---|---|
| 4,239,235 | Torres |
| 4,253,671 | Pace |
| 4,457,513 | Thompson |
| 3,435,487 | Mazzei |
| 4,415,163 | Schoenig |
| 1.015.722 | France |
| 8785 | Great Britain |

Torres discloses a training device for football or for all games using a small or large ball. Torres may be relevant to the present application in that it discloses an inextensible net stretched between upright members with elastic means 5 attached to upright members and extending outward toward the net.

Pace discloses a pole structure for supporting a net for a field game. Pace discloses a fairly complex pole structure that has a system of pulleys and a length of elastic material 31 coupled at one end to allow stretching from a net and coupled at the other end to the bottom of the pole to maintain tension in the net.

Thompson discloses a rebound ball game and apparatus therefor. Thompson discloses a net with springs 62 attaching the net to some type of support member.

Mazzei discloses an athletic net stabilization. Mazzei includes resilient connectors arranged for attachment to one end of a rigid standard and for double attachment to net suspension ropes.

Schoenig discloses a portable volleyball apparatus. Shoenig discloses ties secured to induce resilient tension in the ties. This resilient tension is provided by rubber collars 52, 56, 62 and 64 being stretched.

The French Patent discloses a volleyball support, including some sort of tension device shown at element "E". The British Patent to Powers discloses the use of a spring "B", although the purpose is not clear.

Although the foregoing references disclose a variety of net tensioning means, it is to be noted that none reveal a volleyball net with elastic tensioning means fixedly attached to the net itself. The references cited fail to eliminate the problem of having to pull against the weight of the net while trying to tie off the net to the elastic means. As the elastic means in the invention disclosed herein is fixedly attached to the net and is capable of being secured immediately to a support, it is unlikely that sagging will arise. The invention disclosed in this application eliminates the need for any knots whatsoever and therefore eliminates the possibility of sagging due to slipping knots or the possibility of the net sliding down the pole due to a loose knot.

The elastic means contemplated for use in this invention consists of bungie cord which may be manufactured in large rolls, then cut to size and secured to the net by crimps. The elastic means of the disclosed references are molded rubber or metal springs which are more expensive to manufacture than bungie cord. Thus, the device disclosed in this application is an inexpensive solution to net tensioning.

Since the elastic means are permanently attached to the net, the possibility of lost apparatus is eliminated. In many of the disclosed references, the elastic means are not permanently attached to the net. Therefore, with the disclosed references, if the elastic means are misplaced or lost, expenditures of additional time or money are required to find or purchase elastic means. Thus it is clear that the device disclosed in the present application is novel and non-obvious in view of the cited references.

SUMMARY OF THE INVENTION

A self-tensioning net for volleyball or the like attachment to external net supports according to one embodiment of the present invention comprises an elongated net with bindings on the top and both sides; a plurality of elastic stretch cords attached at a first effective end to the net in the bindings at the corner; a hook, with an O-shaped aperture at one end and a U-shaped hook at the other end, attached to the elastic stretch cord, at its second effective end, through the O-shaped aperture; and, reinforcing overlays riveted to the upper corners of the net.

A second embodiment of a self-tensioning net for attachment to external net supports includes all the elements of the first embodiment as well as draw strings extending the length of the net with the draw strings being attached to a third effective end of the elastic stretch cord.

One object of the present invention is to provide an improved net for volleyball or the like.

A second object of the present invention is to provide a net which may be quickly and easily set up without having to tie any knots which may slip or which may be difficult to tie while pulling against the weight of the net.

A further object of the present invention is to provide a net which, once attached to external supports, requires no further adjustment due to slippage of knots.

Yet a further object of the present invention is to provide a self-tensioning net which may be manufactured inexpensively.

Another object of the present invention is to provide a self-tensioning net which has the tensioning and attachment elements securely attached at all times to the net to prevent the loss thereof and to reduce game set up time.

Related objects and advantages of the present invention will be apparent from the following description.

DESCRIPTION OF THE PREFERRED EMBODIMENT

Figure 1:
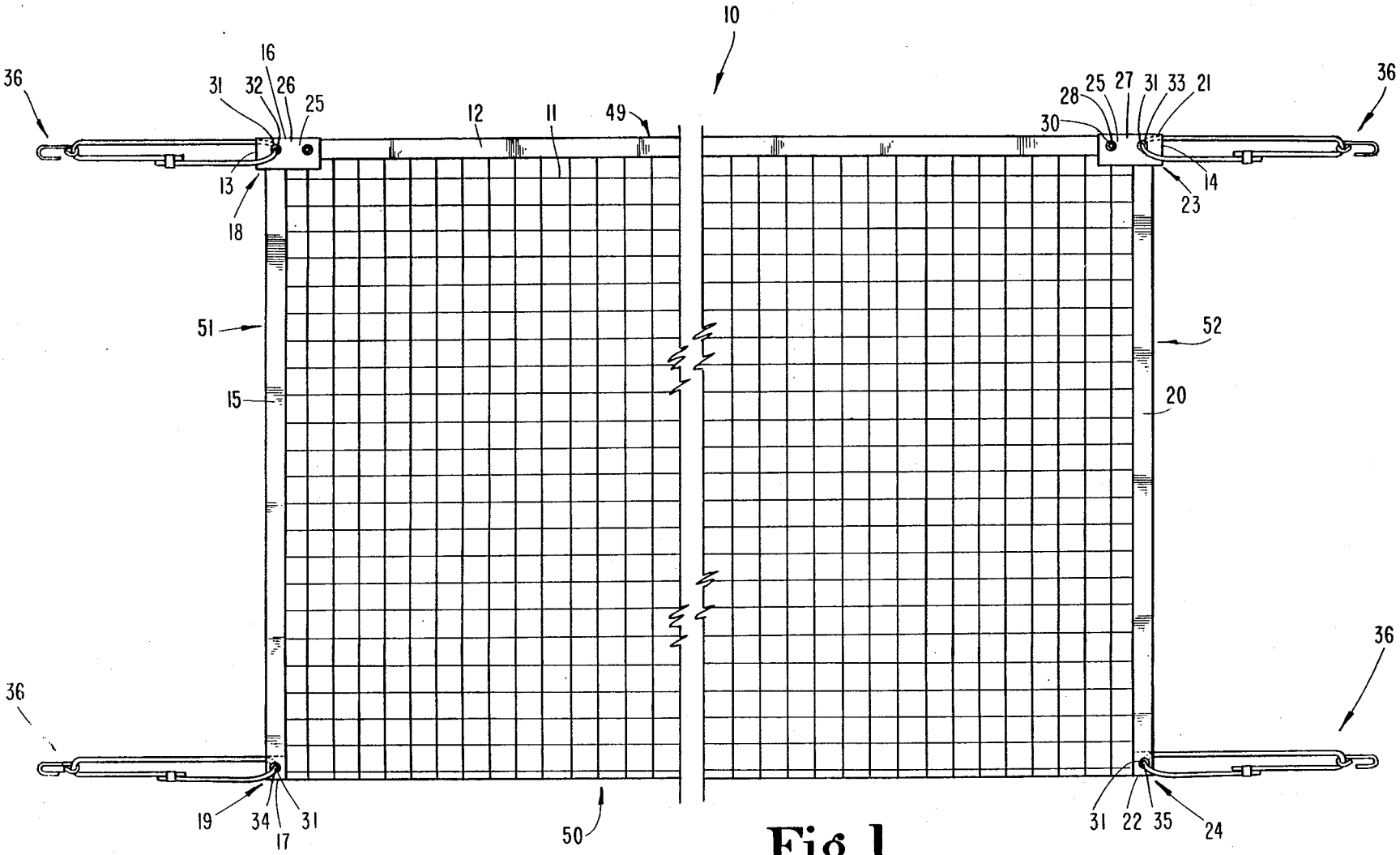
FIG. 1 is a front view of a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
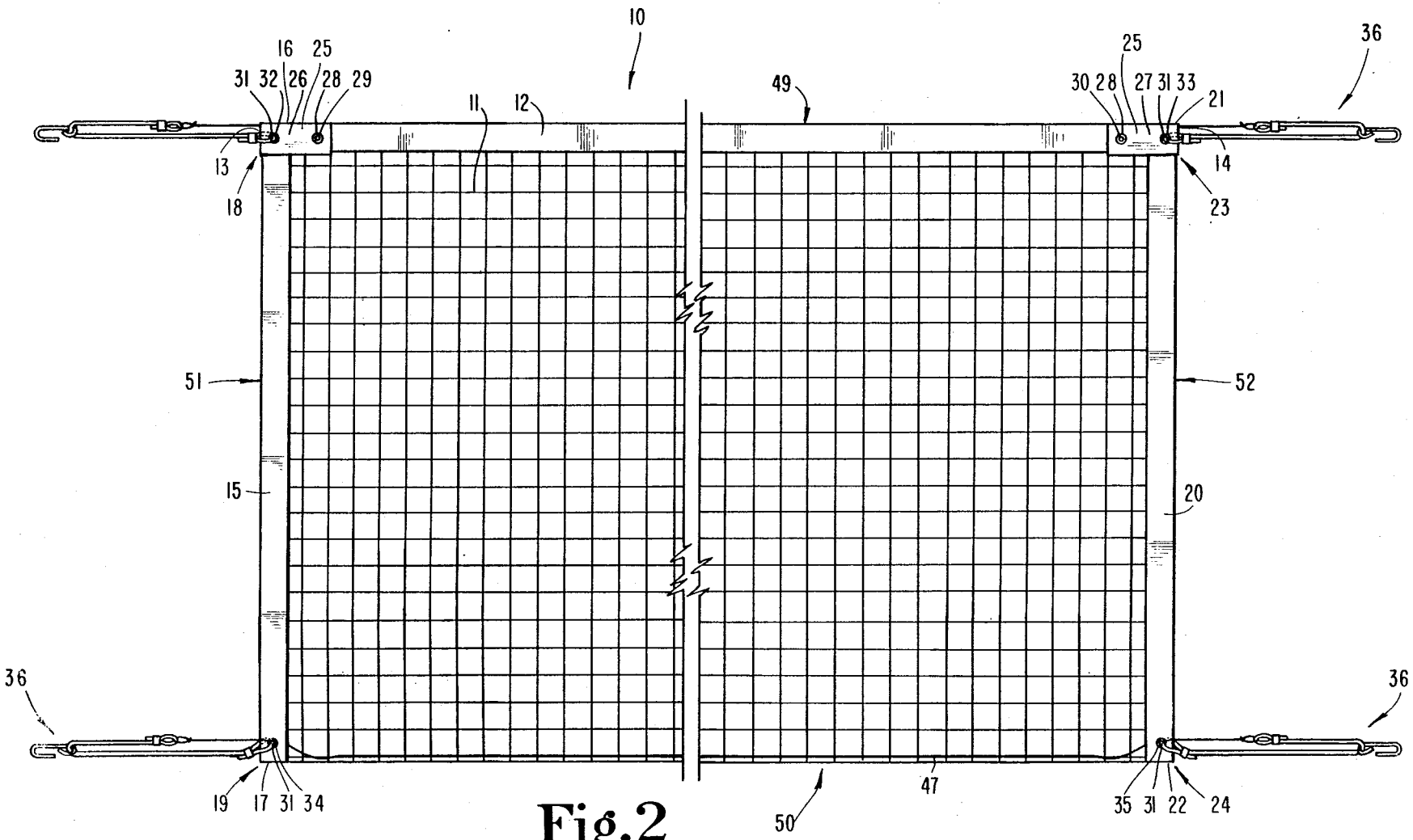
FIG. 2 is a front view of a second envisioned embodiment of the present invention.

Referring to FIGS. 1 and 2, there is illustrated a self-tensioning volleyball net 10 for attachment to external net supports. The self-tensioning volleyball net 10 consists of an elongated rectangular net 11 that has a top edge 49, a bottom edge 50, a first side edge 51 and a second side edge 52. This net is of typical construction and is therefore mesh in appearance, a typical material for constructing such net would be polyethylene. Along top edge 49 is attached a first inextensible binding 12 that encompasses top edge 49. First inextensible binding 12 has a first top binding end 13 and a second top binding end 14. Along first side edge 51 is a second inextensible binding 15 which has a first side binding end 16 and a second side binding end 17. The first side binding end 16 of second inextensible binding 15 overlaps with the first top binding end 13 of first inextensible binding 12 to form a first top corner 18. The second side binding end 17 of second inextensible binding 15 forms a first bottom corner 19. Along second side edge 52 and encompassing that edge is a third inextensible binding 20 with a first side binding end 21 and a second side binding end 22. The first side binding end 21 of the third inextensible binding 20 overlaps the second top binding end 14 of the first inextensible binding 12 to form a second top corner 23. The second side binding end 22 of the third inextensible binding 20 forms a second bottom corner 24. First inextensible binding 12, second inextensible binding 15, and third inextensible binding 20 wrap around the edges of the net and are then typically sown in place.

At the top corners of the net are reinforcing overlays 25 with a first top corner reinforcing overlay 26 being located at first top corner 18 and a second top corner reinforcing overlay 27 being located at second top corner 23. Reinforcing overlays 25 are attached to the top corners by means of rivets 28 (FIGS. 3 and 4) with a first top corner rivet 29 attached at first top corner 18 and a second top corner rivet 30 attached at second top corner 23. Grommets 31 with holes therethrough to act as receiving means for receiving attachment means are located in each of the corners. First top of corner grommet 32 is located in first top corner 18, second top corner grommet 33 is located in second top corner 23, first bottom corner grommet 34 is located in first bottom corner 19 and second bottom corner grommet 35 is located in second bottom corner 24. Grommets 31 are provided to allow the net to be secured to attaching means which pass therethrough.

Tensioning attachment means 36 are located at each of the corners of the net. These tensioning attachment means consist of an elastic stretch cord 37 having a first end 38, a second end 39, a first effective end 40 and a second effective end 41. First effective end 40 is defined by the point in the elastic stretch cord which passes through Grommets 31, while second effective end 41 is defined by the point of the elastic stretch cord 37 which passes through a hooking means 42 when the net is secured to an external net support. The hooking means 42 includes a shank 43 with a first end 53 and a second end 54. At the first end 53 of the shank 43 is a U-shaped bend 44 to act as a hook. At the second end 54 of the shank 43 is an O-shaped bend 45 to act as a elastic stretch cord receiving means. Elastic stretch cord 37 passes through O-shaped bend 45 and when stretched defines second effective end 41.

Figure 3:
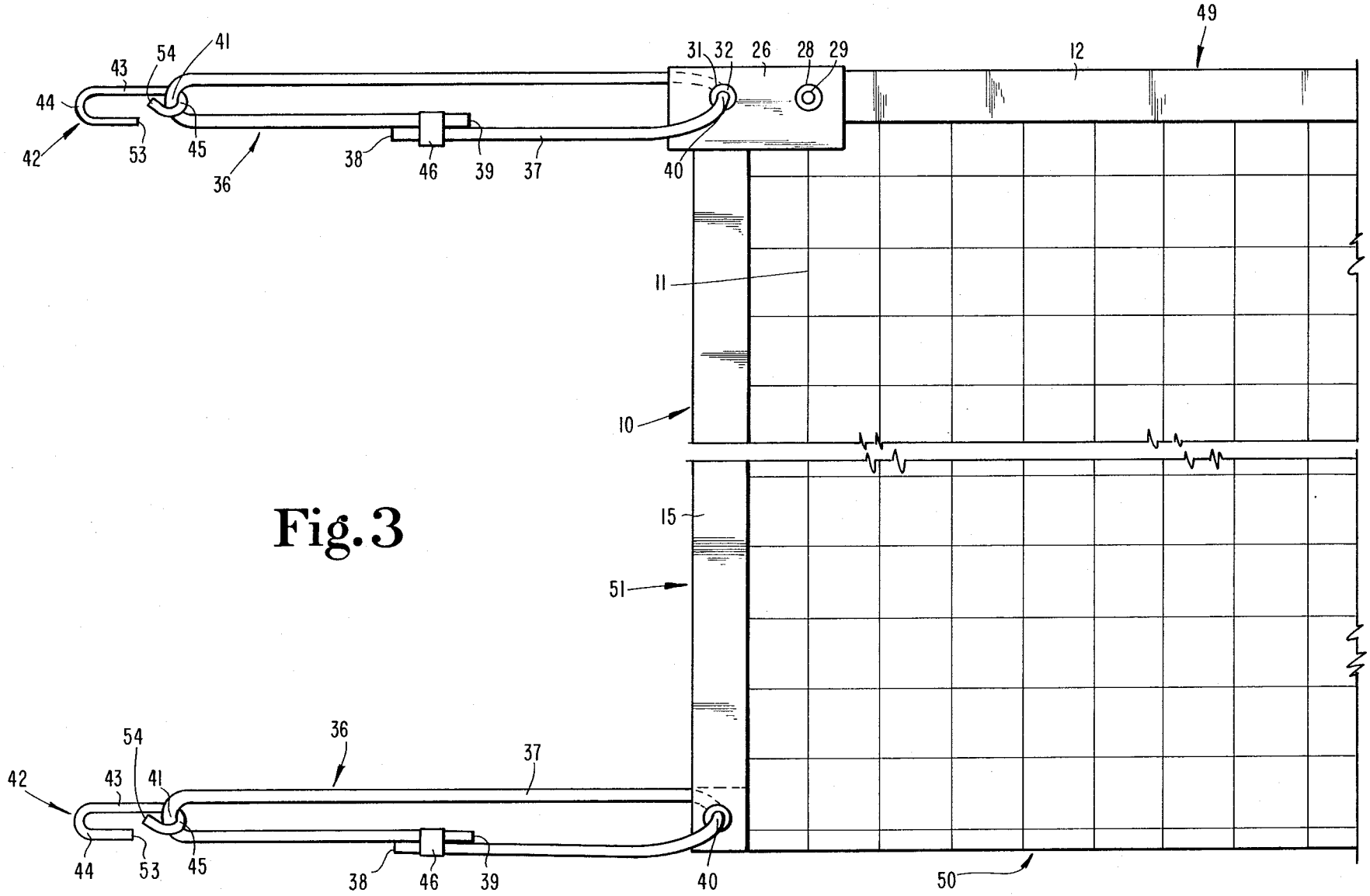
FIG. 3 is a fragmentary view of the end of the embodiment illustrated in FIG. 1.

Referring more particularly to FIG. 1 and FIG. 3, one embodiment of the present invention is illustrated. First end 38 and second end 39 of elastic stretch cord 37 are attached to one another by means of a crimp 46. Thus in the first embodiment a loop is formed, with the first effective end 40 of elastic stretch cord 37 being defined by that end which passes through grommet 31. Second effective end 41 of elastic stretch cord 37 is defined by that end of the loop which passes through the O-shaped bend 45 of the hooking means 42. The U-shaped bend 44 in hooking means 42 is provided to allow for the net to be secured to an external net support with a hole appropriately positioned therein so as to prevent the net from sliding along the pole.

Figure 4:
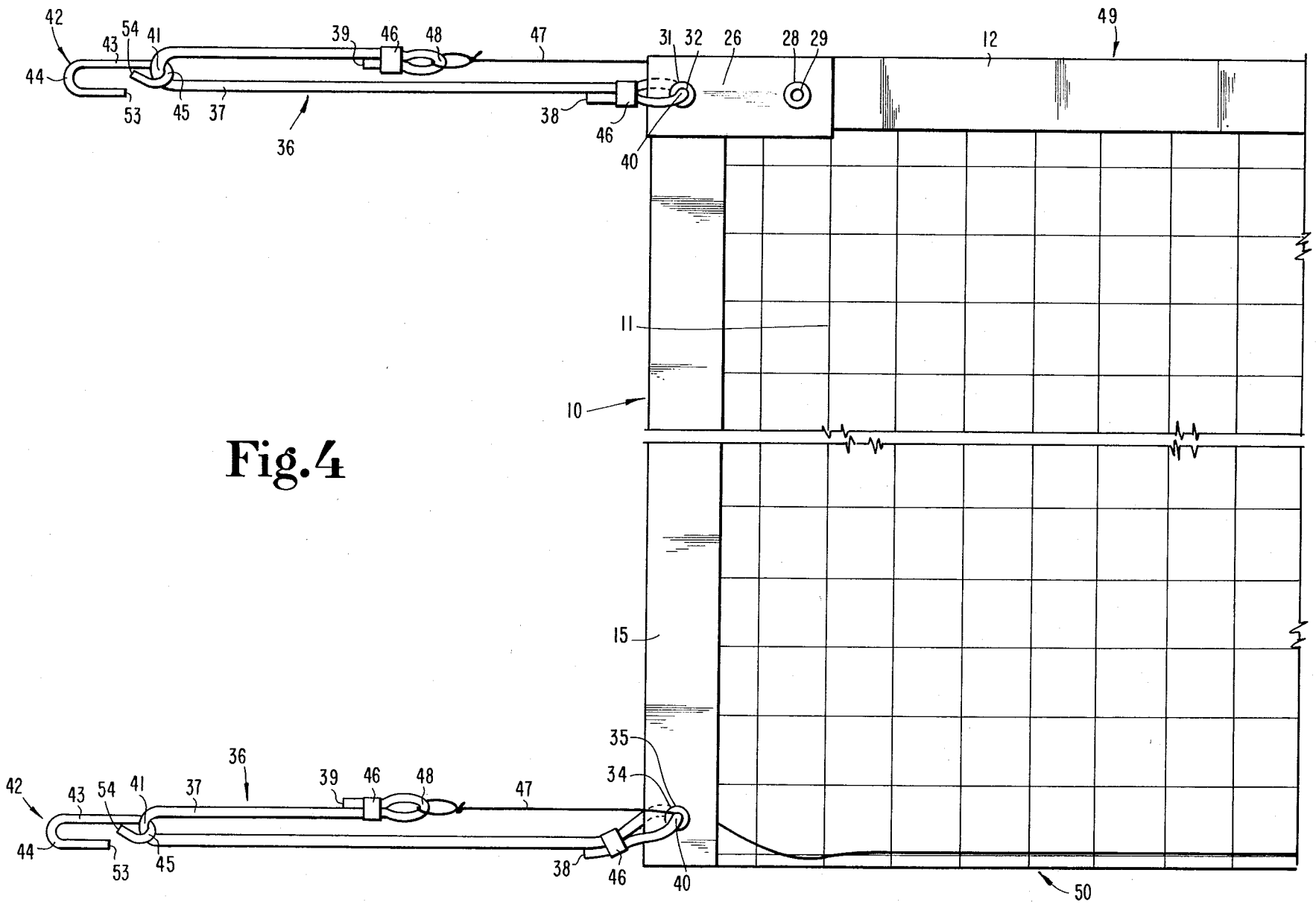
FIG. 4 is a fragmentary view of the second embodiment illustrated in FIG. 2.

Referring now more particularly to FIG. 2 and FIG. 4, there is illustrated a second embodiment of the present invention. In the second embodiment of the present invention, there is included draw strings 47 that are inextensible and extend the length of net 11 along the top edge 49 and bottom edge 50. One drawstring is encompassed by top binding 12 as it extends along top edge 49. As is illustrated, first effective end 40 is formed by attaching first end 38 of elastic stretch cord 37 to elastic stretch cord 37 at a point distant from second end 39. This attachment is accomplished by a crimp 46. The second embodiment includes a third effective end 48 that is formed by the attachment of second end 39 of elastic stretch cord 37 to elastic stretch cord 37 at a point distant from the first end 38. One end of draw string 47 passes through and is attached to third effective end 48. In the second embodiment, the second effective end 41 of elastic stretch cord 37 is defined by the point in the elastic stretch cord 37 where the O-shaped bend of hooking means 42 rests when the net is attached to an external net support.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-tensioning volleyball net for attachment to external net supports comprising:

an elongated rectangular net, said net having a top edge and a bottom edge defined by its elongated sides and a first side edge and a second side edge defined by its non-elongated sides, said net further having four corners; and, a plurality of tensioning attachment means, extending through said net at said corners, for providing tensioned attachment of the corners to external supports, said attachment means including:

an elastic stretch cord permanently attached to said net, said elastic stretch cord having a first end and a second end as well as a first effective end and a second effective end, said first effective end being permanently received in said net, wherein said first end of said cord is fixedly attached to said cord at a location distant from said second end of said cord and said second end of said cord is fixedly attached to said cord at a location distant from said first end of said cord, a third effective end to said elastic stretch cord being defined by a loop formed by the attachment of said second end of said cord at a location distant from said first end of said cord;

an inextensible drawstring extending along an elongated side of said net, said drawstring being attached to said third effective ends of a plurality of tensioning attachment means; and, hooking means for hooking said net to an external net support, said hooking means attached to said second effective end of said elastic stretch cord.

2. A self-tensioning volleyball net as described in claim 1 wherein said hooking means includes a hook having one end attached to said elastic stretch cord and another end defining a hook bend.

3. A self-tensioning net for attachment to external net supports comprising:

an elongated rectangular net, said net having a top edge and a bottom edge defined by its elongated sides and a first side edge and a second side edge defined by its non-elongated sides;

a first inextensible binding fixedly attached to an elongated edge of said rectangular net, said first binding encompassing and defining the top edge of said net, said first binding having a first end and a second end;

a second inextensible binding fixedly attached to and encompassing said first side edge of said net, said second binding having a first end and a second end, said first end of said second binding overlapping said first end of said first binding to form a first upper corner, said second end of said second binding forming a first lower corner;

a third inextensible binding fixedly attached to and encompassing said second side edge of said net, said third binding having a first end and a second end, said first end of said third binding overlapping said second end of said first binding to form a second upper corner, said second end of said third binding forming a second lower corner;

a plurality of receiving means extending through the bindings at said first upper corner, said second upper corner, said first lower corner and said second lower corner for receiving tensioning attachment means therethrough;

a plurality of tensioning attachment means, extending through said receiving means, for creating appropriate tension in said net when said tensioning attachment means are attached to external net supports said tensioning attachment means includes;

an elastic stretch cord permanently attached to said net, said elastic stretch cord having a first end and a second end as well as a first effective end and a second effective end, said first effective end being permanently received in said receiving means, wherein said first end of said cord is fixedly attached to said cord at a location distant from said second end of said cord and said second end of said cord is fixedly attached to said cord at a location distant from said first end of said cord, a third effective end to said elastic stretch cord being defined by a loop formed by the attachment of said second end of said cord at a location distant from said first end of said cord;

an inextensible drawstring extending along an elongated side of said net, said drawstring being attached to said third effective ends of a plurality of tensioning attachment means; and, a hooking means for hooking said net to an external net support, said hooking means attached to said second effective end of said elastic stretch cord.

4. A self-tensioning net as described in claim 3 wherein said plurality of receiving means includes a plurality of grommets extending through the corners of said net.

5. A self-tensioning net as described in claim 4 and further comprising a plurality of reinforcing overlays fixedly attached to said first upper corner and said second upper corner of said net.

6. A self-tensioning net as described in claim 5 wherein said hooking means includes:

a shank having a first shank end and a second shank end;

a U-shaped bend in said first shank end to form a hook;

an O-shaped bend in said second shank end to form an elastic stretch cord receiving aperture; and, said elastic stretch cord attached to said O-shaped bend at said second effective end of said elastic stretch cord.

7. A self-tensioning net as described in claim 3 wherein said hooking means includes;

a shank having a first shank end and a second shank end:

a U-shaped bend in said first shank end to form a hook;

an O-shaped bend in said second shank end to form an elastic stretch cord receiving aperture; and, said elastic stretch cord attached to said O-shaped bend at said second effective end of said elastic stretch cord.

* * * * *